US012692788B2

(12) United States Patent
Molla et al.

(10) Patent No.: US 12,692,788 B2
(45) Date of Patent: Jul. 28, 2026

(54) DETERMINATION OF ASPHALTENE ONSET CONDITION OF RESERVOIR FLUIDS DURING DOWNHOLE FLUID ANALYSIS

(71) Applicant: Schlumberger Technology Corporation, Sugar Land, TX (US)

(72) Inventors: Shahnawaz Hossain Molla, Cambridge, MA (US); Elham Mahmoodaghdam, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 168 days.

(21) Appl. No.: 18/725,452

(22) PCT Filed: Apr. 5, 2023

(86) PCT No.: PCT/US2023/017555

§ 371 (c)(1),
(2) Date: Jun. 28, 2024

(87) PCT Pub. No.: WO2023/196389

PCT Pub. Date: Oct. 12, 2023

(65) Prior Publication Data

US 2025/0101867 A1 Mar. 27, 2025

Related U.S. Application Data

(60) Provisional application No. 63/362,474, filed on Apr. 5, 2022.

(51) Int. Cl.
*E21B 49/00* (2006.01)
*E21B 47/06* (2012.01)
(Continued)

(52) U.S. Cl.
CPC ..... *E21B 49/10* (2013.01); *E21B 47/06* (2013.01); *E21B 49/0875* (2020.05); *E21B 2200/22* (2020.05)

(58) Field of Classification Search
CPC ..... E21B 2200/22; E21B 47/06; E21B 49/08; E21B 49/0875; E21B 49/10
See application file for complete search history.

(56) References Cited

U.S. PATENT DOCUMENTS 7,586,087 B2 9/2009 Dong
8,434,356 B2 5/2013 Hsu
(Continued)

FOREIGN PATENT DOCUMENTS

WO 2020185840 A1 9/2020

OTHER PUBLICATIONS

WO2020131996A1 (Year: 2020).*
(Continued)

*Primary Examiner* — Dani Fox
(74) *Attorney, Agent, or Firm* — Jeffrey D. Frantz

(57) ABSTRACT

Systems and methods for identifying a likelihood of problematic reservoir fluid containing asphaltene and/or an asphaltene onset pressure (AOP) using downhole fluid analysis data are provided. A method may include retrieving downhole fluid analysis data corresponding to a reservoir fluid that was obtained by a downhole acquisition tool positioned in a wellbore. The method may also include using a statistical model trained using historical downhole fluid analysis data and laboratory measurements to identify, based on the downhole fluid analysis data corresponding to the reservoir fluid, a likelihood of whether the reservoir fluid contains asphaltenes or an asphaltene onset pressure (AOP) of the reservoir fluid.

20 Claims, 7 Drawing Sheets

(51) Int. Cl.
*E21B 49/08* (2006.01)
*E21B 49/10* (2006.01)

(56) References Cited

U.S. PATENT DOCUMENTS

| | | | |
|---|---|---|---|
| 9,109,434 | B2 | 8/2015 | Indo |
| 12,098,526 | B2 | 9/2024 | Takaoka |
| 2013/0112406 | A1 | 5/2013 | Zuo |
| 2016/0177715 | A1 | 6/2016 | Indo |
| 2016/0273354 | A1 | 9/2016 | Chen |
| 2017/0370214 | A1 | 12/2017 | Wang |
| 2019/0120049 | A1 | 4/2019 | Chen |
| 2019/0128117 | A1 | 5/2019 | Dumont |
| 2020/0033317 | A1 | 1/2020 | Patel |
| 2022/0074303 | A1 | 3/2022 | Molla |

OTHER PUBLICATIONS

Hammami, A., et al., Asphaltene Precipitation from Live Oils: An Experimental Investigation of Onset Conditions and Reversibility, Energy Fuels, Jan. 2000, pp. 14-18. vol. 14, No. 1.

Dong. C. et al., New Downhole-Fluid-Analysis Tool for Improved Reservoir Characterization, SPE Reservoir Evaluation Engineering, Dec. 2008, pp. 1107-1116, vol. 11, No. 6.

James, G et al.,, An Introduction to Statistical Learning with Applications in R. Springer Texts in Statistics, 2013, 441 pages.

Hastie, T. et al., The Elements of Statistical Learning, Springer Texts in Statistics, 2009, 764 Pages.

Adyani, W. N., et al., "A Systematic Approach to Evaluate Asphaltene Precipitation during CO2 Injection", presented at the SPE Enhanced Oil Recovery Conference, SPE-143903-MS, Jul. 19, 2011, 27 pages.

Gonzalez, D. L., et. al., "Effects of Gas Additions to Deepwater Gulf of Mexico Reservoir Oil: Experimental Investigation of Asphaltene Precipitation and Deposition", presented at the SPE Annual Technical Conference and Exhibition, SPE-159098-MS, Oct. 8, 2012, 11 pages.

Jamaluddin, A. K. M. et al., "A Comparison of Various Laboratory Techniques to Measure Thermodynamic Asphaltene Instability", presented at the SPE Asia Pacific Improved Oil Recovery Conference, SPE-72154-MS, Oct. 8, 2001, 17 pages.

Jamaluddin, A. K. M., et al., "An Investigation of Asphaltene Instability Under Nitrogen Injection", presented at the SPE International Petroleum Conference and Ehibition in Mexico, SPE-74393-MS, Feb. 10, 2002, 10 pages.

Joshi, N. B. et al., "Asphaltene Precipitation from Live Crude Oil", Energy Fuels, Jun. 6, 2001, 15(4), pp. 979-986.

Kalantari-Dahaghi, A. et al., "Formation Damage Through Asphaltene Precipitation Resulting From CO2 Gas Injection in Iranian Carbonate Reservoirs", SPE Production Operations, May 19, 200, 23(2), pp. 210-214.

* cited by examiner

DETERMINATION OF ASPHALTENE ONSET CONDITION OF RESERVOIR FLUIDS DURING DOWNHOLE FLUID ANALYSIS

CROSS-REFERENCE TO RELATED APPLICATIONS

This application is a National Stage Entry of International Application No. PCT/US2023/017555, filed Apr. 5, 2023, which claims the benefit of U.S. Provisional Application No. 63/362,474 entitled "Determination of Asphaltene Onset Condition of Reservoir Fluids During Downhole Fluid Analysis," filed Apr. 5, 2022, the disclosure of which is incorporated herein by reference in its entirety.

BACKGROUND

The present disclosure generally relates to measurement of reservoir fluid composition, and more particularly to determining asphaltene onset pressure of a reservoir fluid or whether the reservoir fluid contains asphaltenes based on downhole fluid analysis data.

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as admissions of any kind.

Producing hydrocarbons from a wellbore drilled into a geological region is a remarkably complex endeavor. In many cases, decisions involved in hydrocarbon exploration and production may be informed by measurements from downhole well-logging tools that are conveyed deep into the wellbore. The measurements may be used to infer properties or characteristics of the geological region surrounding the wellbore.

The properties of the formation fluid have a substantial impact on well development and production. Asphaltene onset pressure (AOP), for example, describes a relationship between temperatures and pressures of the formation fluid at which the formation fluid begins to precipitate asphaltene components. During well development or production, it may be possible for the formation fluid to reach temperatures and pressures that cross the AOP envelope. When this happens, asphaltenes may begin to precipitate out of the formation fluid, which could result in a number of well-production challenges. Asphaltene precipitation can cause production-choking deposition inside tubulars and pipelines as well as a reduction in permeability of the reservoir rock. Indeed, Asphaltenes are the most polar components in crude oil and are defined by their solubility; for example, asphaltenes are soluble in toluene and insoluble in excess amount of heptane (ASTM D6560, 2005). Asphaltenes can deposit in reservoirs, wellbore tubing, flow-lines, separators, and the like. The deposits can interrupt and potentially stop production due to the formation of plugs. During production, the solubility of the asphaltenes in the crude oil decreases as the pressure decreases as the fluid travels through the reservoir and the well bore. The asphaltene onset pressure (AOP) is the pressure at which asphaltenes first begin to precipitate at a fixed temperature. Asphaltene deposition can begin deep in the wellbore while the pressure is well above the bubble point. Asphaltenes can also precipitate during miscible flooding with CO2 and natural gases as well as due to comingling of different fluids.

Hydrocarbon producers would like to know the existence of problematic asphaltenes in their reservoir fluids as early as possible. It is also valuable to understand the conditions that induce asphaltene precipitation. The concentration of asphaltenes and their precipitation/deposition tendencies have an impact on the value of a reservoir. Furthermore, asphaltenes affect downstream operations such as in refineries. Therefore, early detection of concentration and potential precipitate formation is critically valuable.

Currently, the asphaltene onset condition (pressure, temperature, and composition) in crude oil is determined by systematic depressurization (at constant temperature) of the sample in PVT cell in the laboratory. In the cell, precipitation of asphaltene is detected based on visual observation, or light scattering.

Upon completion of the isothermal depressurization, the content of the cell is filtered out through a high-pressure post-filter, slightly above the indicated saturation pressure, to collect the solid precipitates on the filter. Following post filtration, the cell is thoroughly rinsed with toluene. The post-filter, filtrate and toluene rinse are then collected and subjected to asphaltene quantification by gravimetric measurement (modified IP-143, ASTM D6560 etc.). However, a proper asphaltene content measurement may entail a minimum of 2 gram of sample assuming 0.5-10 wt-% of asphaltenes. Performing asphaltene content measurements on smaller amounts collected from the post-filtration step may result in an erroneous measurement and thus inconclusive experiment results. Additionally, the IP-143 procedure involves the use of a large volume of organic solvents and sensitive mass measurement equipment in a controlled laboratory environment. Therefore, this asphaltene quantification technique is not suitable for on-site or downhole application.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

This disclosure relates to identifying a likelihood that a reservoir fluid is problematic due to asphaltenes or other problematic features and/or an asphaltene onset pressure (AOP) using downhole fluid analysis (DFA) measurements, using a trained model that has been trained using historical DFA measurements corresponding to laboratory measurements. For example, laboratory determinations of whether a fluid is problematic (e.g., asphaltenes will precipitate, asphaltenes will not precipitate) may be correlated with historical DFA measurements of a particular sample. This historical data may be used to train a classification model that can identify, based on downhole fluid analysis measurements of a new reservoir fluid, whether the new reservoir fluid is problematic. Likewise, laboratory determinations of asphaltene onset pressure (AOP) may be correlated with historical DFA measurements of a particular sample. This historical data may be used to train a regression model that can identify, based on downhole fluid analysis measurements of a new reservoir fluid, an estimated asphaltene onset pressure (AOP) of the new reservoir fluid.

Thus, a method may include retrieving downhole fluid analysis data corresponding to a reservoir fluid that was obtained by a downhole acquisition tool positioned in a wellbore. The method may also include using a statistical model trained using historical downhole fluid analysis data and laboratory measurements to identify, based on the downhole fluid analysis data corresponding to the reservoir fluid, a likelihood of whether the reservoir fluid contains asphaltenes or an asphaltene onset pressure (AOP) of the reservoir fluid.

A system may include a downhole acquisition tool with a downhole fluid analysis module configured to obtain downhole fluid analysis corresponding to a reservoir fluid and processing circuitry. The processing circuitry may implement a first statistical model trained using first historical downhole fluid analysis data and laboratory measurements to identify, based on the downhole fluid analysis data corresponding to the reservoir fluid, a likelihood of whether the reservoir fluid contains asphaltenes or an asphaltene onset pressure (AOP) of the reservoir fluid.

A method to train such models may include collecting, for respective samples of a plurality of samples of reservoir fluids, historical downhole fluid analysis data and laboratory data. The method may also include training a model to identify, based on the historical downhole fluid analysis data and laboratory data, a likelihood of whether a new reservoir fluid contains asphaltenes or an asphaltene onset pressure (AOP) of the new reservoir fluid.

BRIEF DESCRIPTION OF THE DRAWINGS

Various aspects of this disclosure may be better understood upon reading the following detailed description and upon reference to the drawings in which.

DETAILED DESCRIPTION

Figure 1:
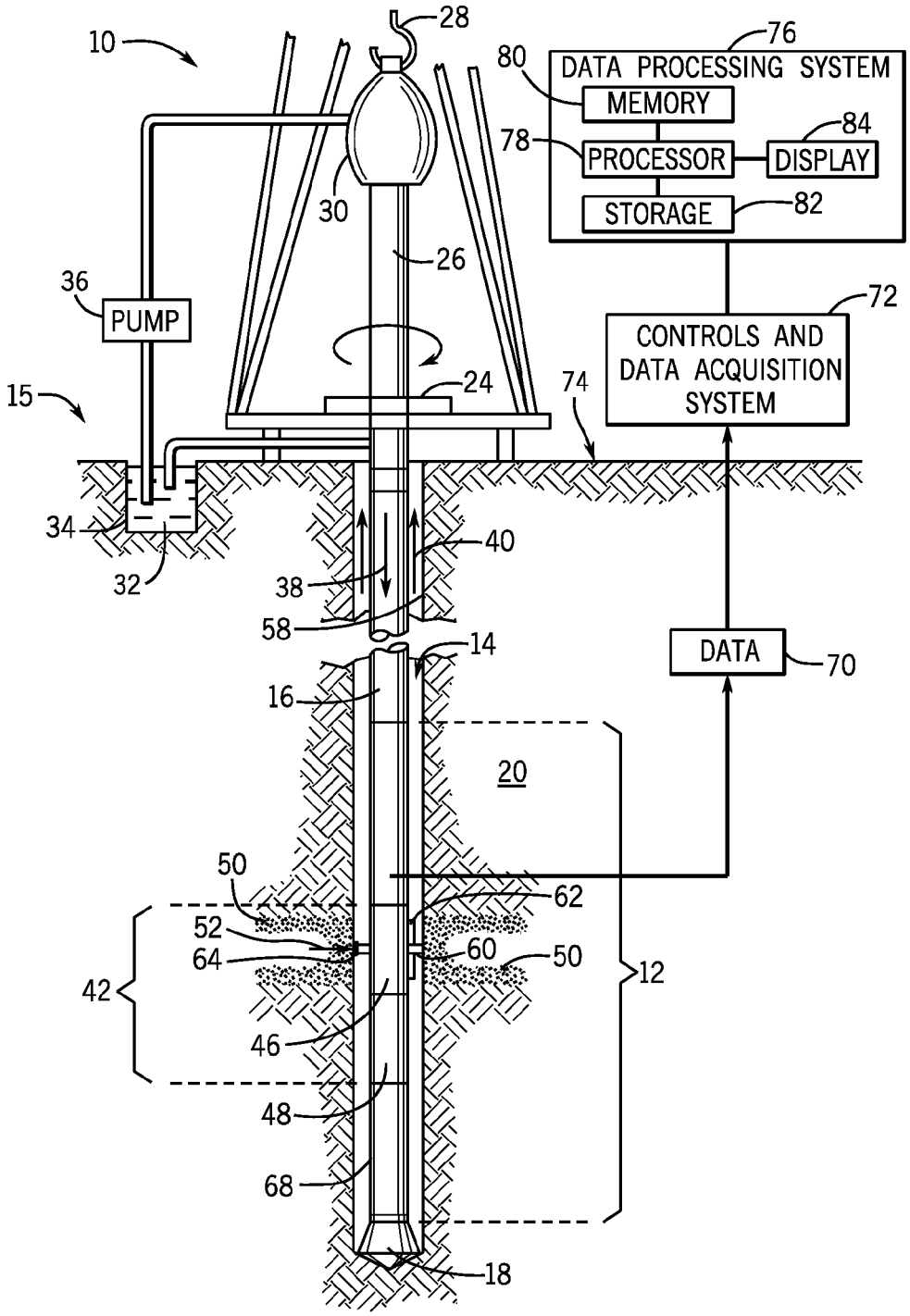
FIG. 1 is a schematic diagram of one example of a downhole fluid analysis (DFA) system that may be used to identify whether a reservoir likely contains a problematic formation fluid with asphaltenes or other challenging features.

One or more specific embodiments of the present disclosure will be described below. These described embodiments are only examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features. As used herein, the terms "connect", "connection", "connected", "in connection with", and "connecting" are used to mean "in direct connection with" or "in connection with via one or more elements"; and the term "set" is used to mean "one element" or "more than one element". Further, the terms "couple", "coupling", "coupled", "coupled together", and "coupled with" are used to mean "directly coupled together" or "coupled together via one or more elements". As used herein, the terms "up" and "down"; "upper" and "lower"; "top" and "bottom"; and other like terms indicating relative positions to a given point or element are utilized to more clearly describe some elements. Commonly, these terms relate to a reference point at the surface from which drilling operations are initiated as being the top point and the total depth being the lowest point, wherein the well (e.g., wellbore, borehole) is vertical, horizontal or slanted relative to the surface.

This disclosure provides a workflow that uses fluid measurements made downhole (e.g., now known or future known Downhole Fluid Analyzer (DFA) measurements) to 1) evaluate the possibility of a fluid being problematic (e.g., the potential for damaging asphaltene precipitation) and 2) estimate other physical properties of the reservoir fluid that are not directly measured at present, such as asphaltene precipitation conditions of a reservoir fluid. The estimations may be obtained rapidly (e.g., substantially in real time), allowing reservoir fluids to be evaluated to determine possible flow assurance issues due to asphaltene precipitation. As a consequence, a producer may be prepared for the particular challenges of the reservoir fluid even though these aspects may not be directly measured. This may have a substantial technical effect of facilitating improved well development, planning, and production. Indeed, understanding the fluid properties of a particular reservoir may facilitate reservoir development, planning, and selecting appropriate enhanced oil recovery techniques to increase reservoir productivity.

Figure 2:
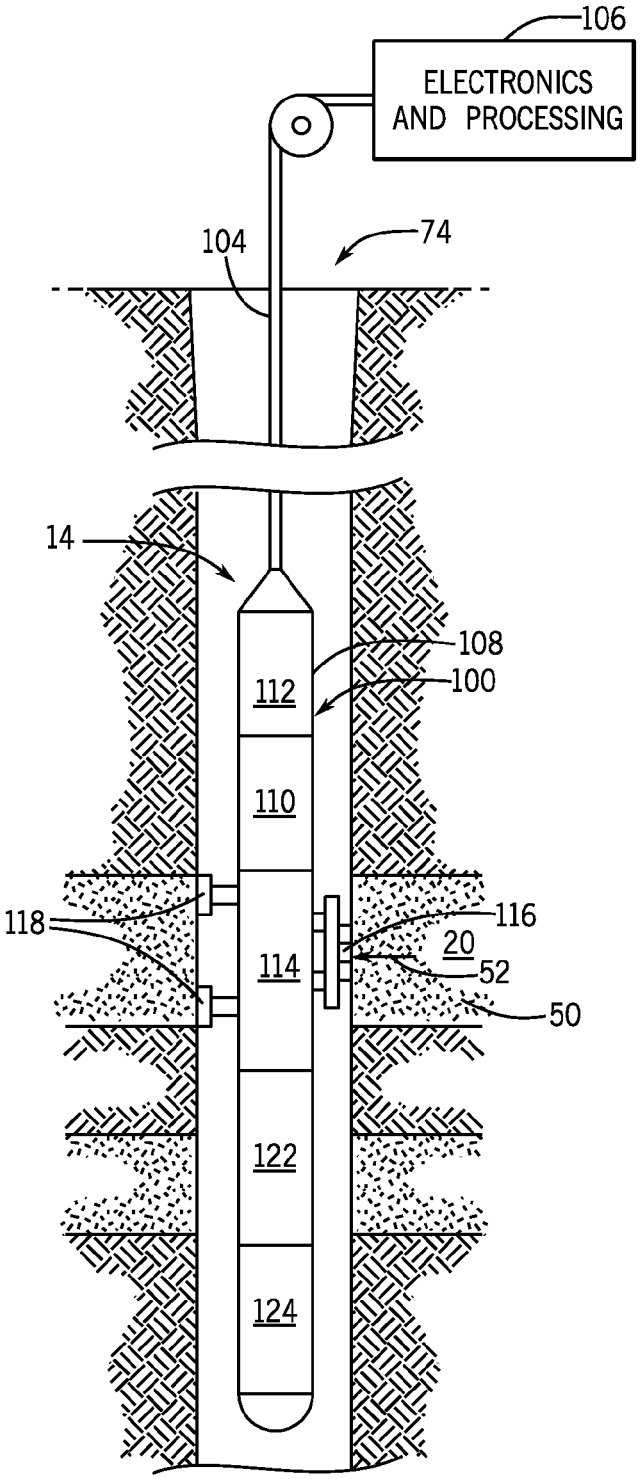
FIG. 2 is a schematic diagram of another example of a downhole fluid analysis (DFA) system that may be used to identify whether a reservoir likely contains a problematic formation fluid with asphaltenes or other challenging features.

FIGS. 1 and 2 depict examples of wellsite systems that may employ fluid analysis systems. FIG. 1 depicts a rig 10 with a downhole acquisition tool 12 suspended from the rig 10 and into a wellbore 14 of a reservoir 15 via a drill string 16. The downhole acquisition tool 12 has a drill bit 18 at its lower end thereof that is used to advance the downhole acquisition tool 12 into geological formation 20 and form the wellbore 14. The drill string 16 is rotated by a rotary table 24, energized by means not shown, which engages a kelly 26 at the upper end of the drill string 16. The drill string 16 is suspended from a hook 28, attached to a traveling block (also not shown), through the kelly 26 and a rotary swivel 30 that permits rotation of the drill string 16 relative to the hook 28. The rig 10 is depicted as a land-based platform and derrick assembly used to form the wellbore 14 by rotary drilling. However, in other embodiments, the rig 10 may be an offshore platform.

Drilling fluid or mud 32 (e.g., oil base mud (OBM)) is stored in a pit 34 formed at the well site. A pump 36 delivers the drilling fluid 32 to the interior of the drill string 16 via a port in the swivel 30, inducing the drilling mud 32 to flow downwardly through the drill string 16 as indicated by a directional arrow 38. The drilling fluid exits the drill string 16 via ports in the drill bit 18, and then circulates upwardly through the region between the outside of the drill string 16 and the wall of the wellbore 14, called the annulus, as indicated by directional arrows 40. The drilling mud 32 lubricates the drill bit 18 and carries formation cuttings up to the surface as it is returned to the pit 34 for recirculation.

The downhole acquisition tool 12, sometimes referred to as a bottom hole assembly ("BHA"), may be positioned near the drill bit 18 and includes various components with capabilities, such as measuring, processing, and storing information, as well as communicating with the surface. A telemetry device (not shown) also may be provided for communicating with a surface unit (not shown). As should be noted, the downhole acquisition tool 12 may be conveyed on wired drill pipe, a combination of wired drill pipe and wireline, or other suitable types of conveyance.

In certain embodiments, the downhole acquisition tool 12 includes a downhole fluid analysis system. For example, the downhole acquisition tool 12 may include a sampling system 42 including a fluid communication module 46 and a sampling module 48. The modules may be housed in a drill collar for performing various formation evaluation functions, such as pressure testing and fluid sampling, among others. As shown in FIG. 1, the fluid communication module 46 is positioned adjacent the sampling module 48; however, the position of the fluid communication module 46, as well as other modules, may vary in other embodiments. Additional devices, such as pumps, gauges, sensor, monitors or other devices usable in downhole sampling and/or testing also may be provided. The additional devices may be incorporated into modules 46, 48 or disposed within separate modules included within the sampling system 42.

The downhole acquisition tool 12 may evaluate fluid properties of reservoir fluid 50. Accordingly, the sampling system 42 may include sensors that may measure fluid properties such as gas-to-oil ratio (GOR), mass density, optical density (OD), composition of carbon dioxide ($CO_2$), water ($H_2O$), $C_1$, $C_2$, $C_3$, $C_4$, $C_5$, and $C_{6+}$, formation volume factor, viscosity, resistivity, fluorescence, American Petroleum Institute (API) gravity, temperature, and/or any other suitable measurements of the reservoir fluid 50 (e.g., using equipment such as a filter array spectrometer, fluorescence detector, grating spectrometer, pressure/temperature gauge, resistivity sensor, density sensor, viscosity sensor). Indeed, the composition of the reservoir fluid 50 may be inferred by measuring the optical information of the formation fluid using a downhole spectrometer that measures optical absorbance of the fluid at multiple wavelengths. These optical spectra may be processed to identify the fluid type (oil, gas, gas condensate) and to quantify the weight fraction of hydrocarbons (methane, ethane, propane, n-butane, n-pentane, and hexane plus) and carbon dioxide in the fluid.

The fluid communication module 46 includes a probe 60, which may be positioned in a stabilizer blade or rib 62. The probe 60 includes one or more inlets for receiving the formation fluid 52 and one or more flow lines (not shown) extending into the downhole acquisition tool 12 for passing fluids (e.g., the reservoir fluid 50) through the tool. In certain embodiments, the probe 60 may include a single inlet designed to direct the reservoir fluid 50 into a flowline within the downhole acquisition tool 12. Further, in other embodiments, the probe 60 may include multiple inlets that may, for example, be used for focused sampling. In these embodiments, the probe 60 may be connected to a sampling flow line, as well as to guard flow lines. The probe 60 may be movable between extended and retracted positions for selectively engaging the wellbore wall 58 of the wellbore 14 and acquiring fluid samples from the geological formation 20. One or more setting pistons 64 may be provided to assist in positioning the fluid communication device against the wellbore wall 58.

In certain embodiments, the downhole acquisition tool 12 includes a logging while drilling (LWD) module 68. The module 68 may include a radiation source that emits radiation (e.g., gamma rays) into the formation 20 to determine formation properties such as, e.g., lithology, density, formation geometry, reservoir boundaries, among others. The gamma rays interact with the formation through Compton scattering, which may attenuate the gamma rays. Sensors within the module 68 may detect the scattered gamma rays and determine the geological characteristics of the formation 20 based on the attenuated gamma rays.

The sensors within the downhole acquisition tool 12 may collect and transmit data 70 (e.g., log and/or DFA data) associated with the characteristics of the formation 20 and/or the fluid properties and the composition of the reservoir fluid 50 to a control and data acquisition system 72 at surface 74, where the data 70 may be stored and processed in a data processing system 76 of the control and data acquisition system 72.

The data processing system 76 may include a processor 78, memory 80, storage 82, and/or display 84. The memory 80 may include one or more tangible, non-transitory, machine readable media collectively storing one or more sets of instructions for operating the downhole acquisition tool 12, determining formation characteristics (e.g., geometry, connectivity, etc.) calculating and estimating fluid properties of the reservoir fluid 50. The memory 80 may store data that may be used to determine geological and fluid characteristics of the formation 20 and reservoir fluid 52, respectively. The processor 78 may represent any suitable processing circuitry (e.g., central processing unit (CPU), graphics processing unit (GPU), field programmable gate array (FPGA), an application-specific integrated circuit (ASIC)).

To process the data 70, the processor 78 may execute instructions stored in the memory 80 and/or storage 82. For example, the instructions may cause the processor to use a trained machine learning model to identify, based on the data 70, whether the reservoir fluid 50 is likely to be a problematic fluid that may experience asphaltene precipitation. As such, the memory 80 and/or storage 82 of the data processing system 76 may be any suitable article of manufacture that can store the instructions. By way of example, the memory 80 and/or the storage 82 may be ROM memory, random-access memory (RAM), flash memory, an optical storage medium, or a hard disk drive. The display 84 may be any suitable electronic display that can display information (e.g., logs, tables, cross-plots, reservoir maps) relating to properties of the well/reservoir as measured by the downhole acquisition tool 12. It should be appreciated that, although the data processing system 76 is shown by way of example as being located at the surface 74, the data processing system 76 may be located in the downhole acquisition tool 12. In such embodiments, some of the data 70 may be processed and stored downhole (e.g., within the wellbore 12), while some of the data 70 may be sent to the surface 74 (e.g., in real time). In certain embodiments, the data processing system 76 may use information obtained from petroleum system modeling operations, ad hoc assertions from the operator, empirical historical data (e.g., case study reservoir data) in combination with or lieu of the data 70 to determine certain parameters of the reservoir 15.

FIG. 2 depicts an example of a wireline downhole tool 100 that may employ the systems and techniques described herein to determine formation and fluid property characteristics of the reservoir 15. The downhole tool 100 is suspended in the wellbore 14 from the lower end of a multiconductor cable 104 that is spooled on a winch at the surface 74. Like the downhole acquisition tool 12, the wireline downhole tool 100 may be conveyed on wired drill pipe, a combination of wired drill pipe and wireline, or other suitable types of conveyance. The cable 104 is communicatively coupled to an electronics and processing system 106. The downhole tool 100 includes an elongated body 108 that houses modules 110, 112, 114, 122, and 124 that provide various functionalities including imaging, fluid sampling, fluid testing, operational control, and communication, among others. For example, the modules 110 and 112 may provide additional functionality such as fluid analysis, resistivity measurements, operational control, communications, coring, and/or imaging, among others.

As shown in FIG. 2, the module 114 is a fluid communication module 114 that has a selectively extendable probe 116 and backup pistons 118 that are arranged on opposite sides of the elongated body 108. The extendable probe 116 selectively seals off or isolates selected portions of the wall 58 of the wellbore 14 to fluidly couple to the adjacent geological formation 20 and/or to draw fluid samples from the geological formation 20. The probe 116 may include a single inlet or multiple inlets designed for guarded or focused sampling. The reservoir fluid 50 may be expelled to the wellbore through a port in the body 108 or the formation fluid 50 may be sent to one or more fluid sampling modules 122 and 124. The fluid sampling modules 122 and 124 may include sample chambers that store the reservoir fluid 50. In the illustrated example, the electronics and processing system 106 and/or a downhole control system control the extendable probe assembly 116 and/or the drawing of a fluid sample from the formation 20 to enable analysis of the fluid properties of the reservoir fluid 50, as discussed above.

The presence or absence of asphaltenes that precipitate out of the reservoir fluid 50 may have a significant effect on the production of hydrocarbons from the wellbore 14. As such, this disclosure describes workflows to train and use machine learning models to quickly identify the likelihood and/or onset pressure of asphaltenes in the reservoir fluid 50 using downhole fluid analysis, despite that these characteristics are not directly measured downhole. Indeed, the presence of asphaltenes and the asphaltene onset pressure (AOP) have historically been identified using pressure, volume, and temperature (PVT) cells in a laboratory. For example, systematic depressurization (at constant temperature) of the sample in PVT cell in the laboratory may reveal precipitation of asphaltene based on visual observation or light scattering. By training machine learning models to recognize the likely laboratory determination from observing downhole fluid analysis measurements, problematic reservoir fluids 50 may be identified rapidly (e.g., in real time or near real time, at a wellsite, before a sample of fluid is processed by a laboratory, while the downhole acquisition tool is in the wellbore) and well production decisions may be made more quickly.

Figure 3:
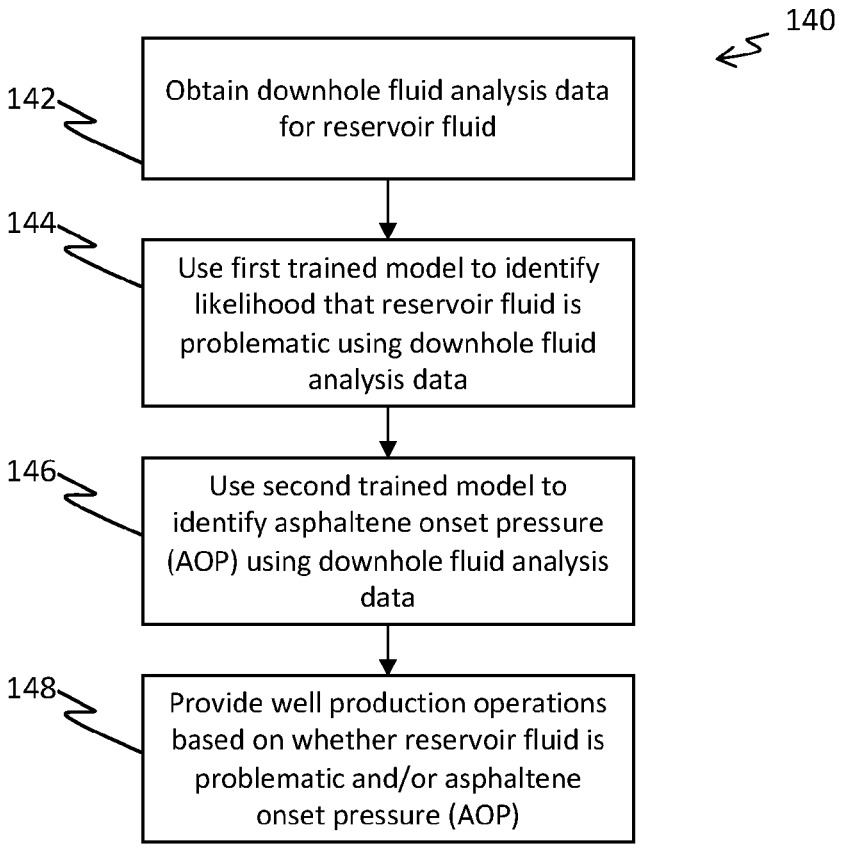
FIG. 3 is a flowchart of a method for producing hydrocarbons from a well based on a likelihood that a reservoir fluid is problematic or based on a likely asphaltene onset pressure (AOP) as identified using trained machine learning models.

Indeed, as shown by a flowchart 140 of FIG. 3, reservoir fluid may be collected and analyzed by a downhole fluid analysis downhole tool to obtain downhole fluid analysis data (block 142). A first trained model, which has been trained using a first set of historical downhole fluid analysis data and laboratory data, may be used to identify a likelihood that the reservoir fluid is problematic (e.g., contains asphaltenes or other problematic features in sufficiently high concentration and/or with sufficient potential for precipitate formation) (block 144). A second trained model, which has been trained using a second set of historical downhole fluid analysis data and laboratory data, may be used to identify a likely asphaltene onset pressure (AOP) (block 146). In other words, measurements from sensors on the downhole fluid analysis (DFA) module of the downhole tool are incorporated into a statistical learning model to classify reservoir fluids based on the potential of being problematic and to estimate the asphaltene precipitation condition of the reservoir fluid. This has a significant technical effect of protecting well equipment from asphaltene precipitation by allowing producers to take action when problematic reservoir fluids 50 are identified (block 148). In one example, when a reservoir fluid 50 is identified as being problematic, the producer may quickly take steps to maintain well pressure above the asphaltene onset pressure (AOP). Although the flowchart 140 describes the use of two distinct trained models, in some embodiments, a single trained model that identifies the likelihood that a fluid is problematic and its asphaltene onset pressure (AOP) may be used.

Figure 4:
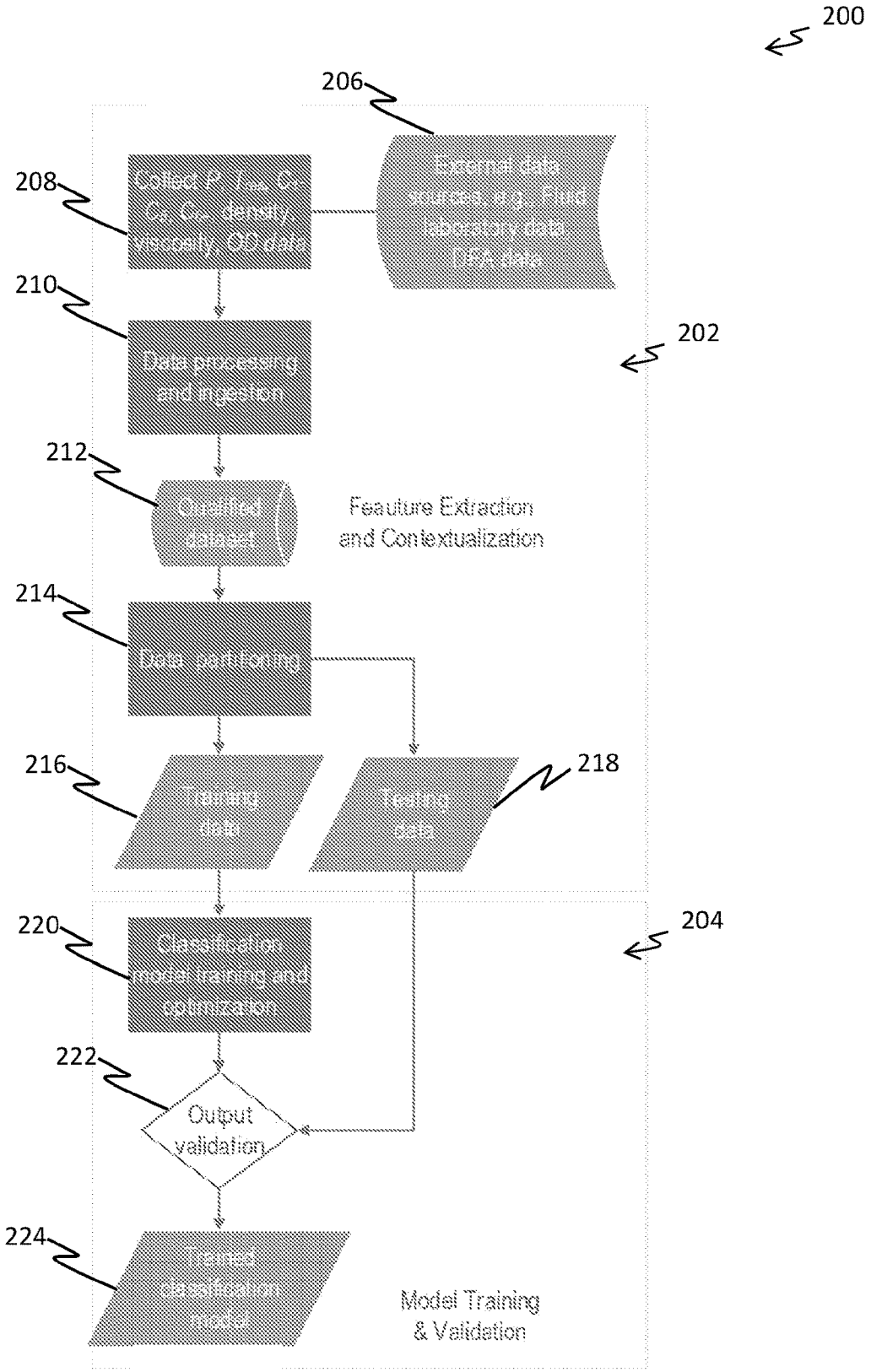
FIG. 4 is a flowchart of a workflow for training a classification model to identify a likelihood that a reservoir fluid is problematic using historical downhole and laboratory fluid analysis data.

FIG. 4 illustrates a workflow 200 by which an example of the first trained statistical model may be obtained to identify a likelihood of asphaltene content or other problematic features. The workflow 200 of FIG. 4 includes a first part 202, in which training data and testing data are obtained through feature extraction and contextualization, and a second part 204, in which the first statistical model is trained and validated using the training data and the testing data. The first part 202 may repeat based on the results of the second part 204 in an iterative manner until the first trained statistical model is obtained to an acceptable level of accuracy. The workflow 200 may take place using any suitable data processing system (e.g., the data processing system 76).

In the first part 202, a variety of historical data including downhole fluid analysis (DFA) data and laboratory measurement data may be provided by external data sources 206 (e.g., database(s) of historical measurements of reservoir fluids). Any suitable data corresponding to a number of historical fluid samples may be obtained (block 208). This may include data for each historical fluid sample such as pressure (P), reservoir temperature ($T_{res}$), carbon content (e.g., $C_1$, $C_2$, $C_3$, $C_4$, $C_5$, and $C_{6+}$), fluid density, fluid viscosity, optical density (OD) data, composition of carbon dioxide ($CO_2$), composition of hydrogen sulfide ($H_2S$), composition of water ($H_2O$), as well as a laboratory determination of whether the fluid sample is problematic (e.g., Y, N) with respect to asphaltene content or other problematic features. Whether a fluid sample is problematic may correspond to a finding by a laboratory that asphaltenes in a sample are found in a sufficiently high concentration (e.g., higher than a threshold concentration) and/or the fluid properties indicate sufficient potential for precipitate formation during production or downstream from production (e.g., midstream, downstream, in refineries).

Not all of the data from the external sources 206 may be statistically helpful to identify whether a given fluid sample will be problematic with respect to asphaltene content or other problematic features. As such, data processing and ingestion (block 210) may be used to generate a qualified dataset 212 that contains a curated set of the originally taken-in historical data. For example, in the data processing and ingestion of block 210, the data corresponding to the number of historical fluid samples may be reduced. For example, data corresponding to outlier reservoir fluids may be removed. Indeed, historical data corresponding to reservoir fluids having features that are not measurable by a downhole fluid analysis module, but which may have an impact on the presence of asphaltenes, may be removed. By way of example, data corresponding to fluid samples containing hydrogen sulfide ($H_2S$) may be excluded from the qualified dataset 212 when the downhole fluid analysis data may not detect the presence of hydrogen sulfide ($H_2S$). Moreover, the data processing and ingestion of block 210 may entail narrowing down the portions of the historical data corresponding to each sample. It may be the case that pressure (P), reservoir temperature ($T_{res}$), certain signals of carbon content (e.g., $C_1$, $C_2$, $C_3$, $C_4$, $C_5$, and $C_{6+}$), composition of carbon dioxide ($CO_2$) or hydrogen sulfide ($H_2S$), fluid density, or fluid viscosity do not impact the prediction of asphaltene content or other problematic features; if so, those components of the data may be excluded. Moreover, there may be multiple channels of optical density (OD) data corresponding to each sample in the historical data, but not every one of these channels of OD data may be useful for predicting asphaltene content or other problematic features. Thus, the data processing and ingestion of block 210 may reduce the number of channels of OD data that are included in the qualified dataset 212. This may be done based on the effectiveness of the resulting trained classification model of the second part 204 of the workflow 200 for a given qualified dataset 212. For example, different qualified datasets 212 may be generated and used to obtain different trained models, and qualified datasets 212 for the trained models that most accurately predict asphaltene content may be further refined until a trained model having some threshold level of accuracy is obtained.

In addition, data corresponding to different samples may have varying nonuniformities from sample to sample. As such, the data processing and ingestion (block 210) may involve fitting (e.g., normalizing) sets of data corresponding to different fluid samples.

Data partitioning (block 214) may entail breaking the data of the qualified dataset 212 into training data 216 and testing data 218. The training data 216 is used to train a classification model using any suitable training or model optimization methods (block 220). The classification model may be a statistically based model, a physics-based model, or a hybrid model. Other now known or future known types of models can be used. Non-limiting examples of models that may be used include support vector machines, random forest, discriminant analysis, naïve Bayes, and nearest-neighbor (e.g., k nearest-neighbor). The training or optimization methods may be understood to represent supervised learning using labels (e.g., problematic: yes or no) provided by laboratory results associated to downhole fluid analysis data. However, additionally or alternatively, unsupervised learning models may be used. Non-limiting examples of unsupervised models that may be used include clustering models such as K-means, K-Medoids, Fuzzy C-means, hierarchical, Gaussian mixture, neural networks, and/or hidden Markov model.

Most of the data of the qualified dataset 212 may be used as training data 216. The remaining testing data 218 may be used for output validation (decision block 222), and thus may include data corresponding to fewer historical samples. The testing data 218 may include data corresponding to at least one sample that was classified by a laboratory as problematic (e.g., asphaltene present) and at least one sample that was classified by a laboratory as not problematic (e.g., asphaltene not present).

Thus, at decision block 222, a classification model generated through training or model optimization in block 220 may be tested by providing the downhole fluid analysis portion of the testing data 218 for a particular fluid sample to the classification model from block 220. The classification model from block 220 may output a likelihood that, based on the downhole fluid analysis or other reservoir data portion of the testing data 218 for that particular fluid sample, that the fluid sample is problematic. Since a laboratory previously classified the fluid sample as problematic (e.g., Y) or not problematic (e.g., N), the accuracy of the prediction of the classification model from block 220 may be compared to the actual laboratory classification. For example, the prediction of the classification model from block 220 may be some value (e.g., a likelihood value between 0 and 1; a likelihood value between 0% and 100%; a binary value of yes or no; a likelihood of low, medium, or high) indicating a likelihood that, based on the downhole fluid analysis or other reservoir data portion of the testing data 218 for a particular fluid sample, that the fluid sample is problematic due to asphaltene precipitation or other problematic features. If the resulting output values for all the testing data 218 is above an acceptable threshold (e.g., more than 50% accurate, more than 60% accurate, more than 65% accurate, more than 70% accurate) (decision block 222), the classification model from block 220 may be output as a final trained classification model 224. Otherwise, training and optimization (block 220) may repeat with different parameters (e.g., using a different training technique, using a different model) and/or a new qualified dataset 212 may be obtained by curating the qualified dataset 212 using different data (e.g., different channels of downhole fluid analysis OD data, different carbon composition data). Indeed, exploratory data analysis techniques can be used to identify the set of input parameters that are relevant for the model. Input parameters can be selected based on their respective influence on the output of the model. These statistical tools provide ways to connect the distinct measurements from the DFA sensor module to the different physical properties of the reservoir fluid.

As shown by a flowchart 240 of FIG. 5, the trained classification model 224 may be subsequently used to rapidly classify reservoir fluid based on downhole fluid analysis data and/or other reservoir parameters 242 from a new reservoir. When reservoir fluid from a new reservoir is obtained in a downhole fluid analysis module of a downhole acquisition tool, new downhole fluid analysis data and/or other reservoir parameters 242 may be collected (block 244). The new downhole fluid analysis data and/or other reservoir parameters 242 may be analyzed by the trained classification model 224 to identify (block 246) a classification 248 of whether the reservoir fluid is problematic (e.g., a likelihood value between 0 and 1; a likelihood value between 0% and 100%; a binary value of yes or no; a likelihood of low, medium, or high). At block 244, the particular data obtained for the current reservoir fluid sample may be curated to match a format of the training data (e.g., having just those data corresponding to the qualified dataset for the trained classification model 224, arranged in the same order as the training data). The reservoir fluid classification of problematic or not problematic may allow a producer to take action quickly, even before a reservoir fluid sample may be obtained and analyzed more thoroughly in a laboratory. Moreover, as new reservoir fluid samples are obtained in additional reservoirs, the additional data may be used as reinforcement learning as the downhole fluid analysis data are analyzed by the trained classification model 224 and then the reservoir fluid is analyzed in a laboratory setting to obtain measured results, which may be compared to the classification provided by the trained classification model 224.

Figure 5:
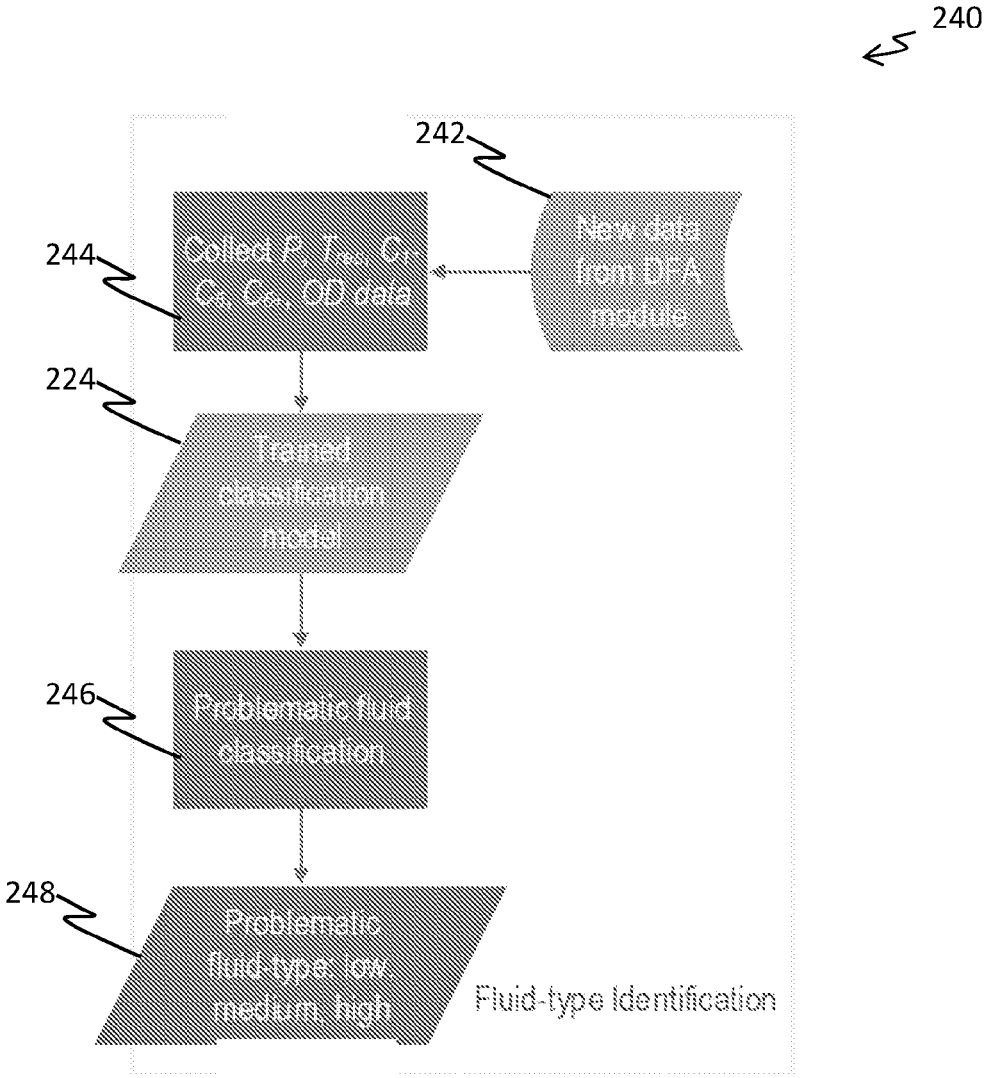
FIG. 5 is a flowchart of a workflow for using the trained classification model to identify a likelihood that a reservoir fluid is problematic using downhole fluid analysis data.
Figure 6:
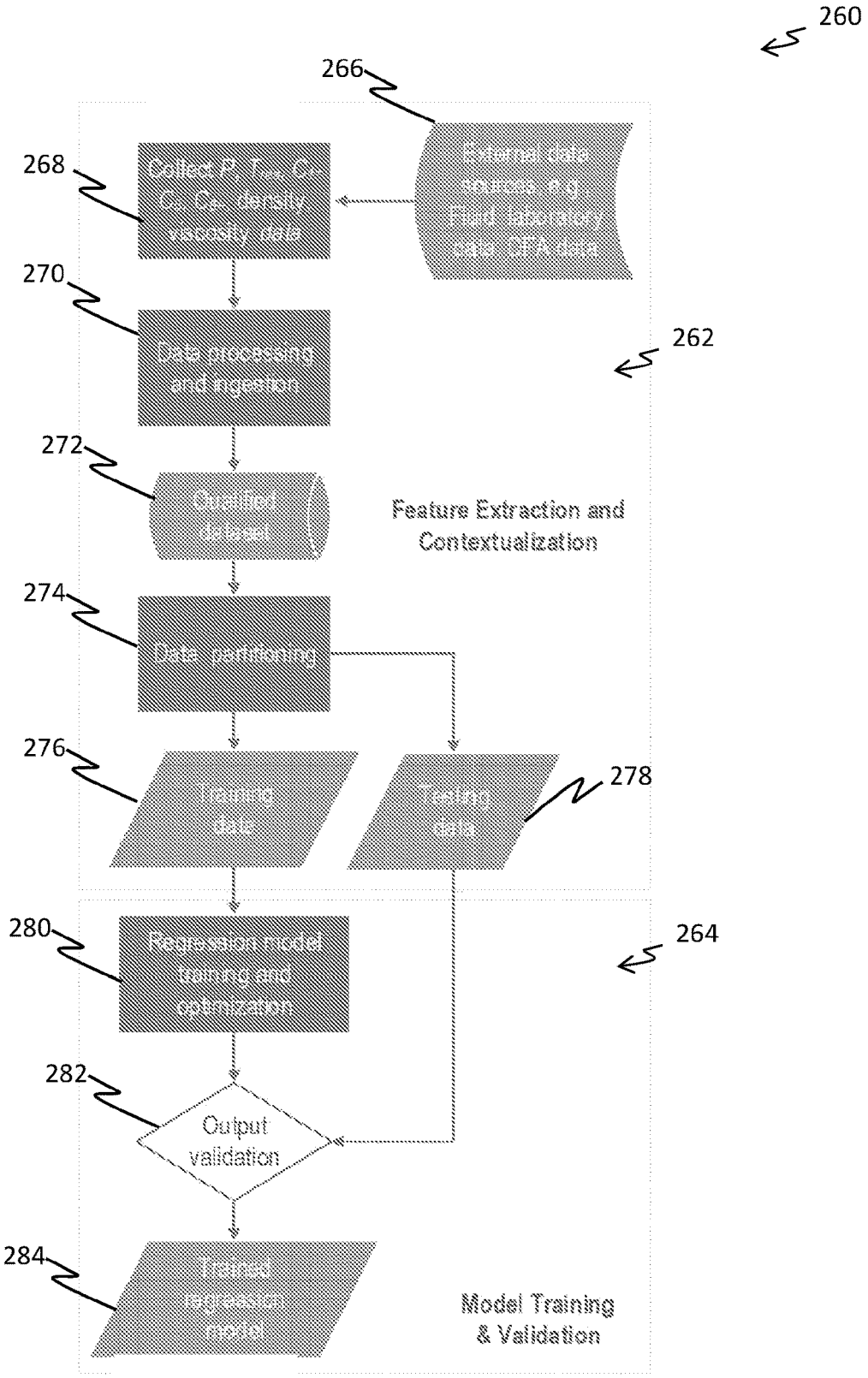
FIG. 6 is a flowchart of a workflow for training a regression model to identify a likely asphaltene onset pressure (AOP) of a reservoir fluid using historical downhole and laboratory fluid analysis data.
Figure 7:
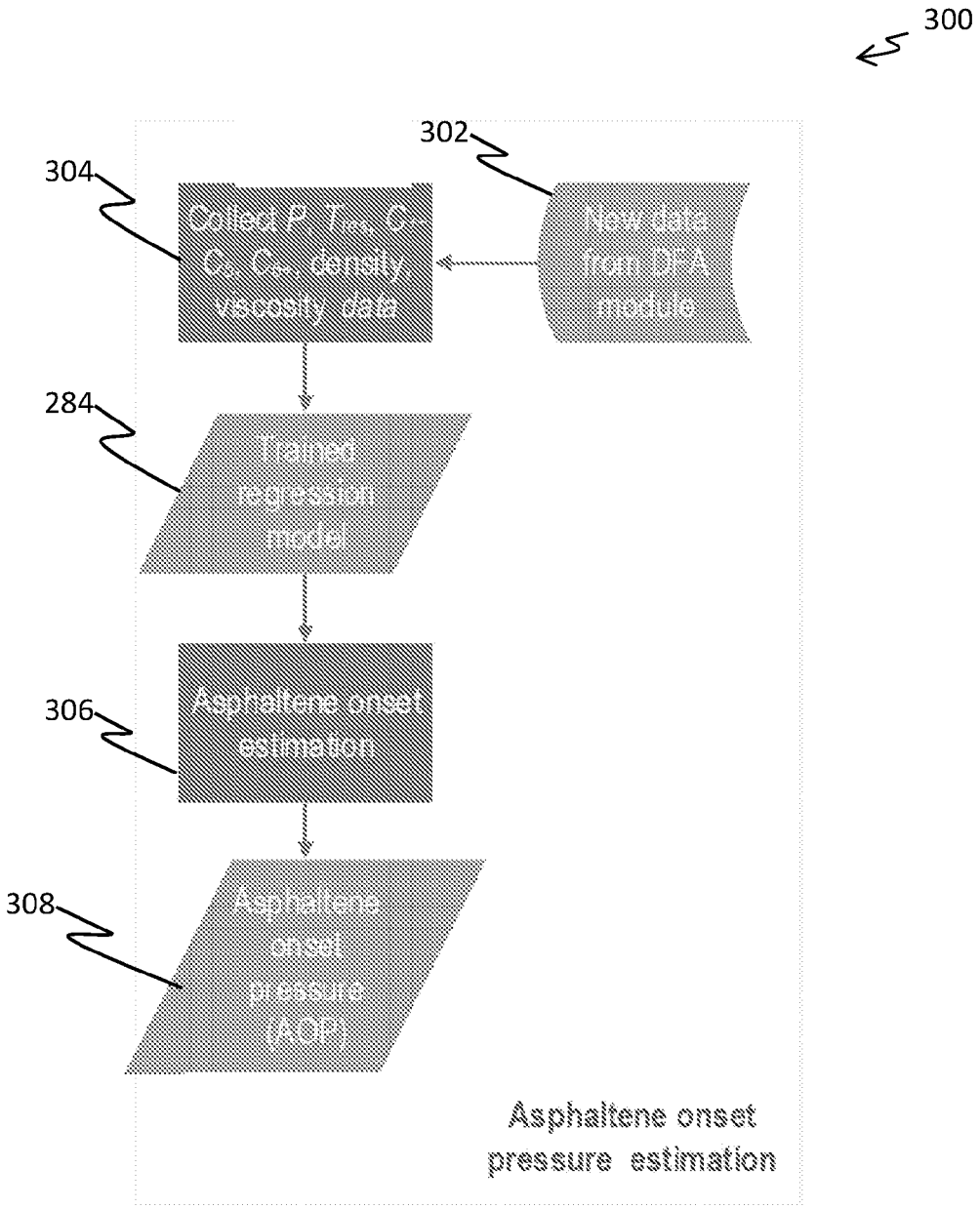
FIG. 7 is a flowchart of a workflow for using the trained regression model to identify a likely asphaltene onset pressure (AOP) of a reservoir fluid using downhole fluid analysis data.

FIGS. 6 and 7 represent workflows like those shown in FIGS. 4 and 5, but instead relate to training a model that can rapidly identify an estimated asphaltene onset pressure (AOP). FIG. 6 illustrates a workflow 260 by which an example of the first trained statistical model may be obtained to identify an estimated asphaltene onset pressure (AOP). The workflow 260 of FIG. 6 includes a first part 262, in which training data and testing data are obtained through feature extraction and contextualization, and a second part 264, in which the first statistical model is trained and validated using the training data and the testing data. The first part 262 may repeat based on the results of the second part 264 in an iterative manner until the first trained statistical model is obtained to an acceptable level of accuracy. The workflow 260 may take place using any suitable data processing system (e.g., the data processing system 76).

In the first part 262, a variety of historical data including downhole fluid analysis (DFA) data and laboratory measurement data may be provided by external data sources 266 (e.g., database(s) of historical measurements of reservoir fluids). Any suitable data corresponding to a number of historical fluid samples may be obtained (block 268). This may include data for each historical fluid sample such as pressure (P), reservoir temperature ($T_{res}$), carbon content (e.g., $C_1$, $C_2$, $C_3$, $C_4$, $C_5$, and $C_{6+}$), fluid density, fluid viscosity, optical density (OD) data, composition of carbon dioxide ($CO_2$), composition of hydrogen sulfide ($H_2S$), composition of water ($H_2O$), as well as a laboratory determination of asphaltene onset pressure (AOP).

Not all of the data from the external sources 266 may be statistically helpful to identify the asphaltene onset pressure (AOP). As such, data processing and ingestion (block 270) may be used to generate a qualified dataset 272 that contains a curated set of the originally taken-in historical data. For example, in the data processing and ingestion of block 270, the data corresponding to the number of historical fluid samples may be reduced. For example, data corresponding to outlier reservoir fluids may be removed. Indeed, historical data corresponding to reservoir fluids having features that are not measurable by a downhole fluid analysis module, but which may have an impact on asphaltene onset pressure (AOP), may be removed. Note that the qualified dataset 272 of FIG. 6 may be different from the qualified dataset 212 of FIG. 4; the trained models of these respective workflows identify different respective features of the reservoir fluid and may depend on different data. Any suitable curating may take place. By way of example, data corresponding to fluid samples containing hydrogen sulfide ($H_2S$) may be excluded from the qualified dataset 272 when the downhole fluid analysis data may not detect the presence of hydrogen sulfide ($H_2S$). Moreover, the data processing and ingestion of block 270 may entail narrowing down the portions of the historical data corresponding to each sample. It may be the case that pressure (P), reservoir temperature ($T_{res}$), certain signals of carbon content (e.g., $C_1$, $C_2$, $C_3$, $C_4$, $C_5$, and $C_{6+}$), composition of carbon dioxide ($CO_2$) or hydrogen sulfide ($H_2S$), fluid density, or fluid viscosity do not impact the prediction of asphaltene onset pressure (AOP); if so, those components of the data may be excluded. Moreover, there may be multiple channels of optical density (OD) data corresponding to each sample in the historical data, but not every one of these channels of OD data may be useful for predicting asphaltene onset pressure (AOP). Thus, the data processing and ingestion of block 270 may reduce the number of channels of OD data that are included in the qualified dataset 272. This may be done based on the effectiveness of the resulting trained regression model of the second part 264 of the workflow 260 for a given qualified dataset 272. For example, different qualified datasets 272 may be generated and used to obtain different trained models, and qualified datasets 272 for the trained models that most accurately predict asphaltene onset pressure (AOP) may be further refined until a trained model having some threshold level of accuracy is obtained.

In addition, data corresponding to different samples may have varying nonuniformities from sample to sample. As such, the data processing and ingestion (block 270) may involve fitting (e.g., normalizing) sets of data corresponding to different fluid samples.

Data partitioning (block 274) may entail breaking the data of the qualified dataset 272 into training data 276 and testing data 278. The training data 276 may be used to train a regression model using any suitable training or model optimization methods (block 220). The regression model may be any suitable statistically based model, a physics-based model, or a hybrid model. Other now known or future known types of models can be used. Non-limiting examples of models that may be used include linear regression, generalized linear model, support vector regression, Gaussian process regression, ensemble methods, decision trees, and neural networks. The training or optimization methods may be understood to represent supervised learning using labels (e.g., values of asphaltene onset pressure (AOP)) provided by laboratory results associated to downhole fluid analysis data. However, additionally or alternatively, unsupervised learning models may be used. Non-limiting examples of unsupervised models that may be used include clustering models such as K-means, K-Medoids, Fuzzy C-means, hierarchical, Gaussian mixture, neural networks, and/or hidden Markov model.

Most of the data of the qualified dataset 272 may be used as training data 276. The remaining testing data 278 may be used for output validation (decision block 282), and thus may include data corresponding to fewer historical samples. The testing data 278 may include data corresponding to at least one sample having an asphaltene onset pressure (AOP) by a laboratory falling within each range desired to be tested (e.g., one set of testing data 278 corresponding to a sample having an asphaltene onset pressure (AOP) in a lower pressure range and one set of testing data 278 corresponding to a sample having an asphaltene onset pressure (AOP) in a higher pressure range). In some cases, the testing data 278 may include a set of data corresponding to a single sample.

Thus, at decision block 282, a regression model generated through training or model optimization in block 280 may be tested by providing the downhole fluid analysis portion of the testing data 278 for a particular fluid sample to the regression model from block 280. The regression model from block 280 may output an estimated value of asphaltene onset pressure (AOP) based on the downhole fluid analysis or other reservoir data portion of the testing data 278. Since a laboratory previously measured the actual asphaltene onset pressure (AOP), the accuracy of the prediction of the regression model from block 280 may be compared to the actual laboratory measurements. For example, the prediction of the regression model from block 280 may be some value of pressure. If the resulting output values for the testing data 278 is within an acceptable threshold range of accuracy (e.g., within some absolute error value, within some relative error value) (decision block 282), the regression model from block 280 may be output as a final trained regression model 284. Otherwise, training and optimization (block 280) may repeat with different parameters (e.g., using a different training technique, using a different model) and/or a new qualified dataset 272 may be obtained by curating the qualified dataset 272 using different data (e.g., different channels of downhole fluid analysis OD data, different carbon composition data). Indeed, exploratory data analysis techniques can be used to identify the set of input parameters that are relevant for the model. Input parameters can be selected based on their respective influence on the output of the model. These statistical tools provide ways to connect the distinct measurements from the DFA sensor module to the different physical properties of the reservoir fluid.

As shown by a flowchart 300 of FIG. 7, the trained regression model 284 may be subsequently used to rapidly estimate asphaltene onset pressure (AOP) of a reservoir fluid based on downhole fluid analysis data and/or other reservoir parameters 302 from a new reservoir. When reservoir fluid from a new reservoir is obtained in a downhole fluid analysis module of a downhole acquisition tool, new downhole fluid analysis data and/or other reservoir parameters 302 may be collected (block 304). The new downhole fluid analysis data and/or other reservoir parameters 302 may be analyzed by the trained regression model 284 to identify (block 306) an estimate of asphaltene onset pressure (AOP) 308. At block 244, the particular data obtained for the current reservoir fluid sample may be curated to match a format of the training data (e.g., having just those data corresponding to the qualified dataset for the trained classification model 284, arranged in the same order as the training data for the trained regression model 284). The estimate of the reservoir fluid asphaltene onset pressure (AOP) 308 may allow a producer to take action quickly, even before a reservoir fluid sample may be obtained and analyzed more thoroughly in a laboratory. Moreover, as new reservoir fluid samples are obtained in additional reservoirs, the additional data may be used as reinforcement learning as the downhole fluid analysis data are analyzed by the trained regression model 284 and then the reservoir fluid is analyzed in a laboratory setting to obtain measured results of asphaltene onset pressure (AOP), which may be compared to the asphaltene onset pressure (AOP) 308 that was estimated by the trained regression model 284 to further tune the trained regression model 284.

Language of degree used herein, such as the terms "approximately," "about," "generally," and "substantially" as used herein represent a value, amount, or characteristic close to the stated value, amount, or characteristic that still performs a desired function or achieves a desired result. For example, the terms "approximately," "about," "generally," and "substantially" may refer to an amount that is within less than 10% of, within less than 5% of, within less than 1% of, within less than 0.1% of, and/or within less than 0.01% of the stated amount. As another example, in certain embodiments, the terms "generally parallel" and "substantially parallel" or "generally perpendicular" and "substantially perpendicular" refer to a value, amount, or characteristic that departs from exactly parallel or perpendicular, respectively, by less than or equal to 15 degrees, 10 degrees, 5 degrees, 3 degrees, 1 degree, or 0.1 degree.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims. It is also contemplated that various combinations or sub-combinations of the specific features and aspects of the embodiments described may be made and still fall within the scope of the disclosure. It should be understood that various features and aspects of the disclosed embodiments can be combined with, or substituted for, one another in order to form varying modes of the embodiments of the disclosure. Thus, it is intended that the scope of the disclosure herein should not be limited by the particular embodiments described above.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. A method comprising:

receiving historical downhole fluid analysis data and historical laboratory measurements, wherein the historical downhole fluid analysis data comprises a pressure, a reservoir temperature, a carbon content, a fluid density, a fluid viscosity, or any combination thereof;

identifying a portion of the historical downhole fluid analysis data by removing one or more first datasets outside a range of values and removing one or more second datasets that are not part of the historical laboratory measurements;

partitioning the portion of the historical downhole fluid analysis data into training data and testing data, wherein the testing data comprises at least one dataset corresponding to a first historical laboratory measurement of the historical laboratory measurements classified as having asphaltene;

identifying downhole fluid analysis data from the testing data, wherein the downhole fluid analysis data corresponds to a reservoir fluid that was obtained by a downhole acquisition tool positioned in a wellbore;

using a statistical model trained using the training data to identify, based on the downhole fluid analysis data corresponding to the reservoir fluid, a likelihood of whether the reservoir fluid contains problematic asphaltenes or an asphaltene onset pressure (AOP) of the reservoir fluid; and verifying the statistical model is accurate based on the testing data.

2. The method of claim 1, wherein the method is performed before a sample of the reservoir fluid is analyzed in a laboratory.

3. The method of claim 1, wherein the method is performed while the downhole acquisition tool is positioned in the wellbore.

4. The method of claim 1, wherein the statistical model comprises a classification model, and the historical laboratory measurements comprise a determination of whether historical reservoir fluid samples contained the problematic asphaltenes.

5. The method of claim 1, wherein the statistical model comprises a regression model, and the historical laboratory measurements comprise measurements of a plurality of asphaltene onset pressures associated with a plurality of historical reservoir fluid samples.

6. The method of claim 1, comprising adjusting the downhole fluid analysis data to match a format of the historical downhole fluid analysis data used to train the statistical model.

7. The method of claim 1, comprising adjusting production of hydrocarbons from the wellbore based on whether the reservoir fluid is identified by the statistical model as being likely to contain the problematic asphaltenes.

8. A system comprising:

a downhole acquisition tool comprising a downhole fluid analysis module configured to obtain downhole fluid analysis data corresponding to a reservoir fluid; and processing circuitry configured to:

receive first historical downhole fluid analysis data and first historical laboratory measurements, wherein the first historical downhole fluid analysis data comprises a pressure, a reservoir temperature, a carbon content, a fluid density, a fluid viscosity, or any combination thereof;

identify a portion of the first historical downhole fluid analysis data by removing one or more first datasets outside a range of values and removing one or more second datasets that are not part of the first historical laboratory measurements;

partition the portion of the first historical downhole fluid analysis data into training data and testing data, wherein the testing data comprises at least one dataset corresponding to a first historical laboratory measurement of the first historical laboratory measurements classified as having asphaltene;

identify the downhole fluid analysis data from the testing data;

implement a first statistical model trained using the training data to identify, based on the downhole fluid analysis data corresponding to the reservoir fluid, a likelihood of whether the reservoir fluid contains problematic asphaltenes or an asphaltene onset pressure (AOP) of the reservoir fluid; and verify the first statistical model is accurate based on the testing data.

9. The system of claim 8, wherein:

the first statistical model is configured to identify the likelihood of whether the reservoir fluid contains the problematic asphaltenes; and the processing circuitry is configured to implement a second statistical model trained using second historical downhole fluid analysis data and second historical laboratory measurements to estimate the AOP.

10. The system of claim 8, wherein the first statistical model is trained using the first historical downhole fluid analysis data and the first historical laboratory measurements to provide a binary answer of whether the reservoir fluid contains the problematic asphaltenes.

11. The system of claim 8, wherein the first statistical model is trained using the first historical downhole fluid analysis data and the first historical laboratory measurements to provide a plurality of possible levels of confidence that the reservoir fluid contains the problematic asphaltenes.

12. The system of claim 8, wherein the first statistical model is trained using the first historical downhole fluid analysis data and the first historical laboratory measurements to provide a percentage level of confidence that the reservoir fluid contains the problematic asphaltenes.

13. The system of claim 8, wherein the first statistical model comprises a classification model configured to identify the likelihood of whether the reservoir fluid contains the problematic asphaltenes.

14. The system of claim 8, wherein the first statistical model comprises a regression model configured to identify the AOP of the reservoir fluid.

15. A method comprising:

collecting, for respective samples of a plurality of samples of reservoir fluids, historical downhole fluid analysis data and historical laboratory measurements, wherein the historical downhole fluid analysis data comprises a pressure, a reservoir temperature, a carbon content, a fluid density, a fluid viscosity, or any combination thereof;

identifying a portion of the historical downhole fluid analysis data by removing one or more first datasets outside a range of values and removing one or more second datasets that are not part of the historical laboratory measurements;

partitioning the portion of the historical downhole fluid analysis data into training data and testing data, wherein the testing data comprises at least one dataset corresponding to a first historical laboratory measurement of the historical laboratory measurements classified as having asphaltene and at least one dataset corresponding to a second historical laboratory measurement of the historical laboratory measurements classified as not having asphaltene;

identifying downhole fluid analysis data from the testing data, wherein the downhole fluid analysis data corresponds to a reservoir fluid that was obtained by a downhole acquisition tool positioned in a wellbore;

training a model using the training data to identify a likelihood of whether a new reservoir fluid contains problematic asphaltenes or an asphaltene onset pressure (AOP) of the new reservoir fluid; and verifying the model is accurate based on the testing data by comparing a result of the model to the at least one dataset corresponding to the first historical laboratory measurement of the historical laboratory measurements classified as having asphaltene and to the at least one dataset corresponding to the second historical laboratory measurement of the historical laboratory measurements classified as not having asphaltene.

16. The method of claim 15, wherein the portion of the historical downhole fluid analysis data is adjusted to exclude historical data corresponding to outlier samples of reservoir fluids having features that are not measurable by a downhole fluid analysis module but which can affect a presence of the problematic asphaltenes.

17. The method of claim 15, wherein the portion of the historical downhole fluid analysis data is adjusted to exclude historical data corresponding to outlier samples of reservoir fluids having hydrogen sulfide ($H_2S$).

18. The method of claim 16, wherein the portion of the historical downhole fluid analysis data is adjusted to exclude components of the historical data that substantially do not impact the presence of the problematic asphaltenes.

19. The method of claim 1, wherein the testing data comprises at least one dataset corresponding to a second historical laboratory measurement of the historical laboratory measurements classified as not having asphaltene.

20. The method of claim 19, wherein verifying the statistical model is accurate based on the testing data comprises comparing a result of the statistical model to the at least one dataset corresponding to the first historical laboratory measurement of the historical laboratory measurements classified as having asphaltene and to the at least one dataset corresponding to the second historical laboratory measurement of the historical laboratory measurements classified as not having asphaltene.

* * * * *